US006908018B1

(12) United States Patent
Barrett

(10) Patent No.: US 6,908,018 B1
(45) Date of Patent: Jun. 21, 2005

(54) RIBBON WHEEL

(76) Inventor: Marian Barrett, 1406 W. Verdugo Ave., Burbank, CA (US) 91506

( * ) Notice: Subject to any disclaimer, the term of this patent is extended or adjusted under 35 U.S.C. 154(b) by 0 days.

(21) Appl. No.: 10/870,283

(22) Filed: Jun. 16, 2004

Related U.S. Application Data

(60) Provisional application No. 60/487,805, filed on Jul. 15, 2003.

(51) Int. Cl.[7] ..... D04D 9/00

(52) U.S. Cl. ..... 223/46; 28/147

(58) Field of Search ..... 28/147, 149, 150, 28/143, 247, 260; 223/44, 46; 428/4, 5; 493/459–462, 955, 957, 958; 83/DIG. 1, 439, 410, 410.7, 267; 242/522, 526, 530, 530.2, 538, 532.6, 532.3; 26/7

(56) References Cited

U.S. PATENT DOCUMENTS 3,249,269 A * 5/1966 Bock et al. ..... 223/46
3,300,107 A * 1/1967 Koch ..... 223/46
3,790,041 A * 2/1974 Pearson et al. ..... 223/46
4,896,802 A * 1/1990 Nanami ..... 223/46
5,232,132 A * 8/1993 Broussard et al. ..... 223/44
5,297,705 A * 3/1994 Schmidt ..... 223/46
5,407,417 A * 4/1995 Goldstein ..... 493/459
5,916,081 A * 6/1999 Goldstein ..... 493/459
6,015,070 A * 1/2000 Barto et al. ..... 223/46
6,298,639 B1 * 10/2001 Shea ..... 223/46
6,360,413 B1 * 3/2002 Lopata et al. ..... 28/147
6,572,521 B2 * 6/2003 Hanna ..... 493/459
6,655,559 B2 * 12/2003 Lopata et al. ..... 223/46

* cited by examiner

*Primary Examiner*—Amy B. Vanatta
(74) *Attorney, Agent, or Firm*—Frank L. Zugelter

(57) ABSTRACT

A ribbon wheel (27) to which lengths of ribbon (22) from spools (65) are wound for ultimate severance into ribbon strands (29). Ribbon material (23) advances from posted spools (65) in compartment (61) of frame (36) of apparatus (20) to their collection at and through slot (67) in top panel (34) of frame (36) for apparatus (20). A post (66) in compartment (61) guides ribbon material (23) to slot (67). The collected ribbon lengths (22) are wound a number of revolutions upon the wheel's peripheral surface (25) formed between the wheel's discs (38, 39) by means of shaft (48) and handle (51) that rotates wheel (27). Recesses (31) in wheel (27) provide points at which the ribbon lengths (22) are severed after ties (85) tie them together at other particular recesses (31) to form multiple ribbon strands (29). A mechanism (75/74) is provided on frame (36) for curling ribbon lengths (22) prior to their introduction to wheel (27). A clip (78) is mounted on frame (36) to prevent slippage of ribbon lengths (22), integral to ribbon material (23), back through slot (67) after severance of them on wheel (27). A revolution counter (54) on frame (36) cooperates with its tripper (55) on wheel (27) to record the number of revolutions undertaken by wheel (27) from which calculation of the number of ribbon strands (29) may be made.

26 Claims, 6 Drawing Sheets

RIBBON WHEEL

This application is related to U.S. Provisional Application No. 60/487,805, filed on Jul. 15, 2003.

TECHNICAL FIELD

This invention is directed to an apparatus for generating strands of one or more ribbons, uncurled or curled, and more particularly, to a simplified apparatus by which one or a multiple number of strands from ribbon material are generated or produced for use in tying of helium balloons and for accessorizing packages, and for other merchandise on which the strands of ribbons provide decorative and restraining effects.

BACKGROUND TO THE INVENTION

Disclosures in prior art teachings describe and illustrate ribbon-strand-making devices or apparata which are directed to either automated modes of operation or more rudimentary cutting and/or curling machines for ribbon strands. This invention is directed to a manually operative ribbon-strand producing apparatus, mechanical in nature, that requires ordinary skill attributes for the operator to manually operate it. Examples of the automated and the more rudimentary or elementary devices for generating strands of ribbons are found in the disclosures of U.S. Pat. Nos. 3,790,041; 5,232,132; 5,407,417; 5,518,492; 5,916,081; 5,711,752; 6,000,586; 6,015,070; 6,298,639; 6,360,413; and 6,655,559.

The present status of the pertinent art to which this invention pertains is directed to automated devices that generate ribbon strands in response to the operation of the automated machines themselves, and do not seek to provide a ribbon strand machine that may be simply operated in a manual fashion for a relatively short duration of time in which only a desired or certain number of ribbon strands are desired to be produced at a point or location at which they are to be utilized. This invention answers a dilemma between more of a rudimental or elementary approach to strand-making devices and the automated machines.

In view of the need to provide an immediate service to customers for a product offered to them for sale, this invention provides a quick and facile procedure by which the customer's demand is met, in a matter of a few minutes, as well as meeting the need for availability of larger quantities of decorative effects of strands of ribbons, curled or uncurled, in a very short period of time.

SUMMARY OF THE INVENTION

The invention is found in an embodiment of an apparatus that includes a rotatable wheel supported within a slot in a top panel of a frame provided with a base to which the top panel is securely mounted by support panels or other support members. A manually operable handle is connected to a shaft concentrically mounted to the wheel, the shaft freely rotatable in a pair of journalled bearings secured to the top panel. The wheel includes a peripheral surface about its circumference for winding one or more ribbon lengths on it, and preferably by way of an annular groove defining within the wheel itself the peripheral surface. Stations such as recesses generally extending radially inwardly from the wheel's circumference are provided and in which ribbon lengths wound on the wheel are cut to produce ribbon strands of different measurements. A compartment is provided in the frame between the top panel and its base and in which one or more spool holders, such as a rod or line of rods vertically-oriented but not necessarily in one vertical line or plane with one another, is secured to the frame within the compartment for supporting one or more spools of uncut ribbon material, and with a head to prevent slippage of spool from the rod or rods. A post generally in parallel alignment with the spool holders is provided in the compartment for pulling ribbon length, say, on the lowest, of spools away from interference with an adjacent spool on its spool holder as it advances by itself, as well as gathering ribbon material from more than one ribbon spool for threading to a slot formed in the top panel, the size of which is at least the width of the widest ribbon material. From the slot in the top panel the threaded ribbon material is advanced to the wheel, however, a curling mechanism in the form of an edge is securely mounted to the top panel adjacent the ribbon's slot for optionally curling the ribbon material prior to it/them being further advanced and wound onto the wheel. Stations such as recesses formed in the wheel are circumferentially spaced about the wheel and at which cuts of ribbon lengths are systematically made to produce ribbon strands. A revolution counter for the wheel is connected to the top panel to co-operate with a tripper attached to the wheel to count the number of revolutions the wheel makes, and calculate therefrom the total number of ribbon strands being generated in a cycle of operation. The measure of the length of ribbon strands is determined by the diameter of the peripheral surface of the wheel.

An object of this invention is to eliminate a totally manually handmade technique with scissors for producing one or more strands of ribbons, curled or uncurled, held in an operator's hands.

Another object of this invention is to provide a simplified and efficient device for cutting ribbon lengths into ribbon strands, curled or uncurled, vis-à-vis rudimental and automated and more expensive devices made for producing ribbon strands.

A still further object of this invention is to provide measured lengths of ribbon strands in a cycle of operation of the apparatus.

Yet another object of this invention is to provide a relatively inexpensive measured ribbon-strand apparatus.

Another object of this invention is to provide a simple, efficient, and easily operable apparatus or device for producing in a quick timely manner measured ribbon strands, curled or uncurled, which then are immediately available for application as a tying or decorative product.

A further object of the invention is to count and measure lengths of ribbon strands, curled or uncurled.

These and other objects of the invention will become more apparent by a full and complete reading of the following description, its appended claims and the accompanying drawing comprising six (6) sheets of eleven (11) FIGURES.

BEST MODE FOR CARRYING OUT THE INVENTION

Figure 8:
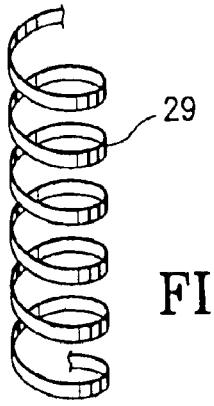
FIG. 8 is a perspective view of a resulting curled ribbon strand.

Turning to the drawing FIGURES in which reference characters correspond to like alphanumerical characters hereinafter, the invention is found in an apparatus 20, FIGS. 1, 2, to which ribbon lengths 22 of uncut ribbon material 23, including different colors, is wound about a peripheral surface 25, FIG. 2, formed on the circumference of a wheel 27 to produce ribbon strands 29, FIG. 8, of measured lengths in one or multiple numbers. Wheel 27 includes severing stations 31 in the form of a series of cut-out portions or recesses spaced along its circumference and at which stations 31 cutting of the wound ribbons sever the lengths of ribbon into ribbon strands 29 of a pre-determined length or lengths. It may be noted that the circumferential spacing between severing stations 31 provides the measurement for the lengths of ribbon strands 29.

Figure 1:
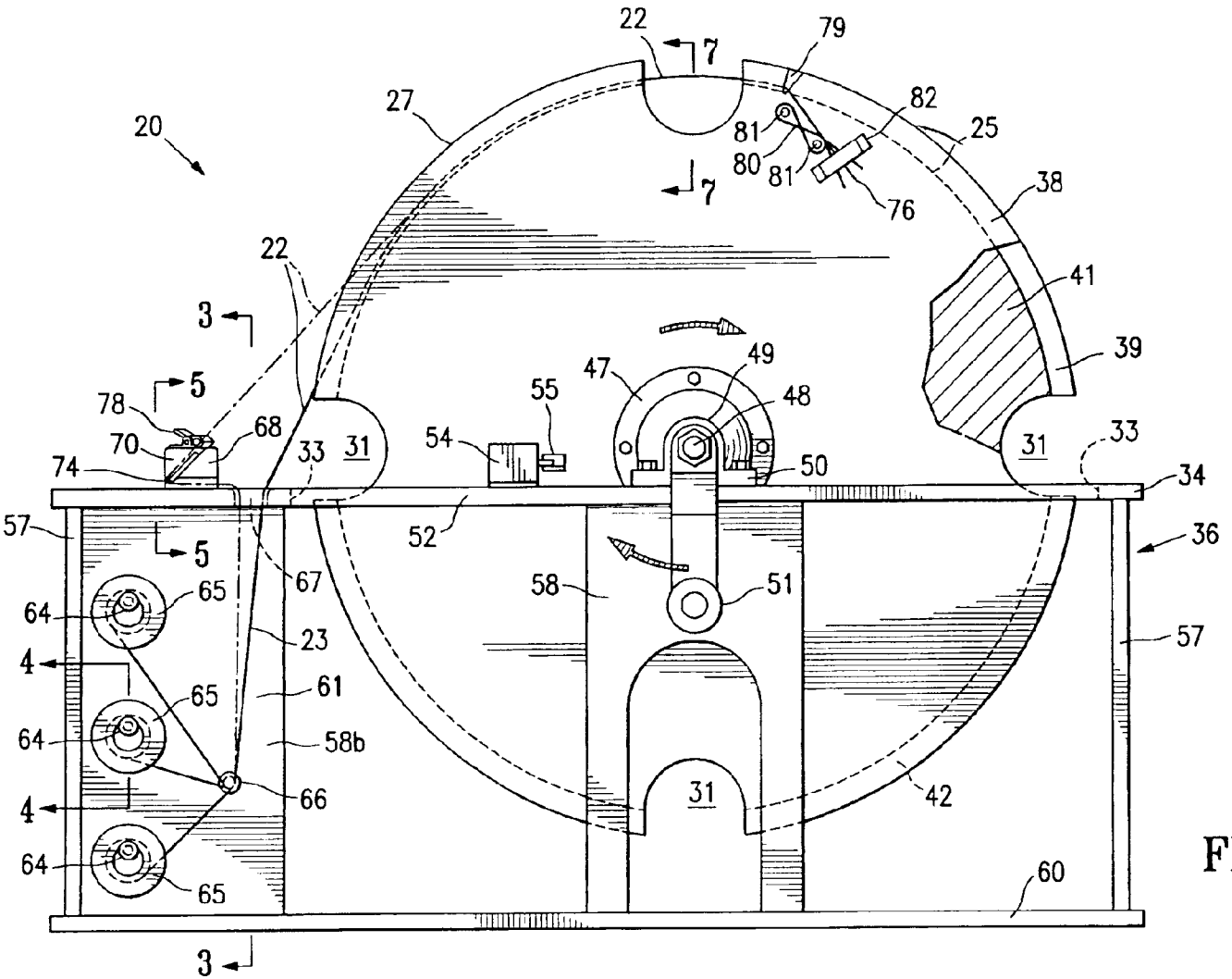
FIG. 1 is an elevational view from a longitudinal side of the apparatus.
Figure 1B:
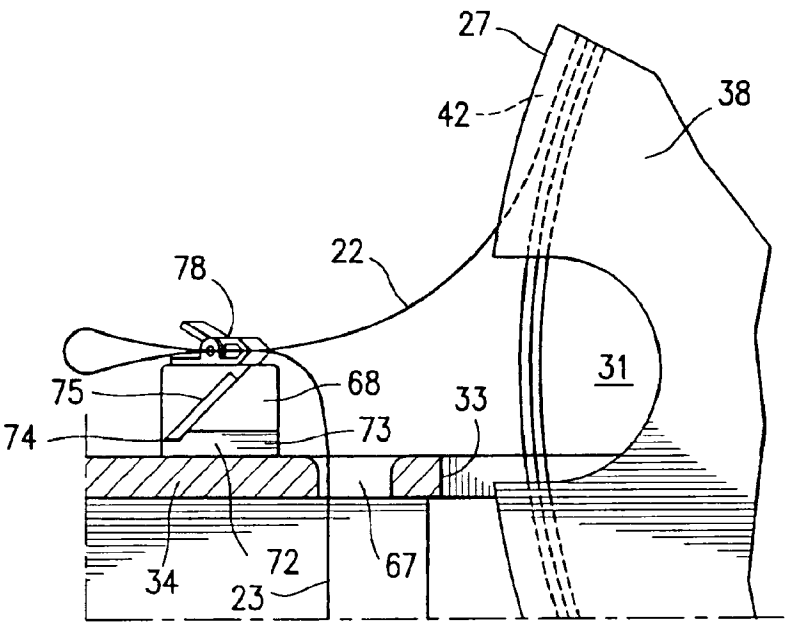
FIG. 1B is an enlarged fragmentary elevational view of the apparatus with illustration of an element of the apparatus by which gravitation, of the next set of lead ends of ribbon lengths after cut of the previous ribbon lengths has produced ribbon strands, back into the compartment of the apparatus is averted.
Figure 1A:
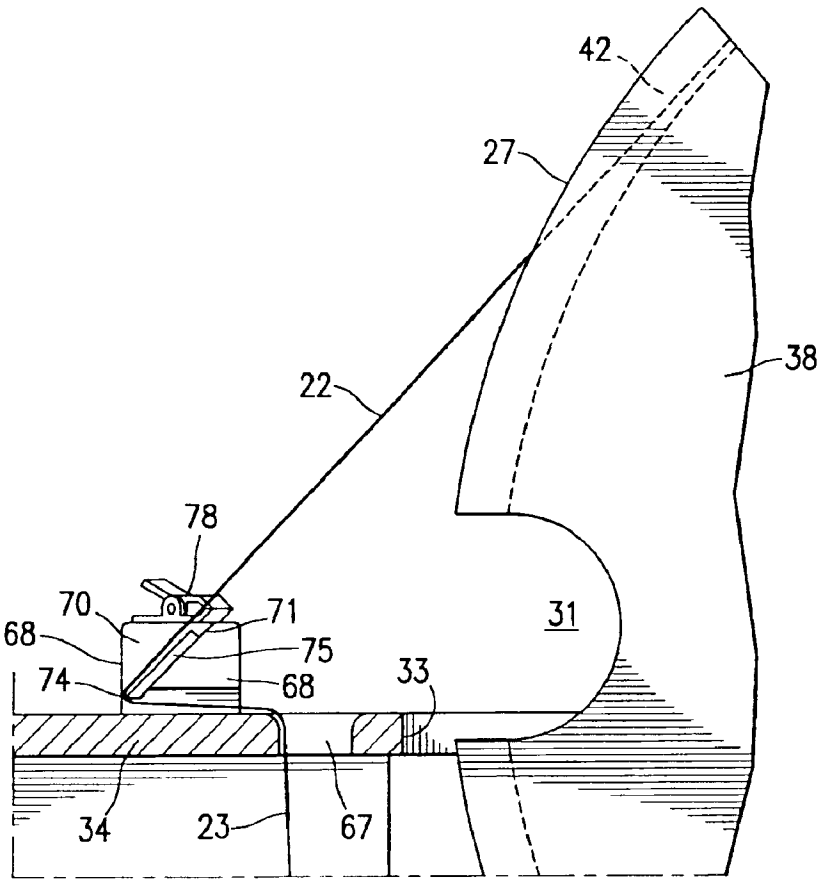
FIG. 1A is an enlarged fragmentary elevational view of the apparatus with illustration of ribbon material applied to an element of the apparatus for curling the ribbon material in operation of the invention prior to advancing it to the wheel for further operation in producing one or more ribbon strands.
Figure 2:
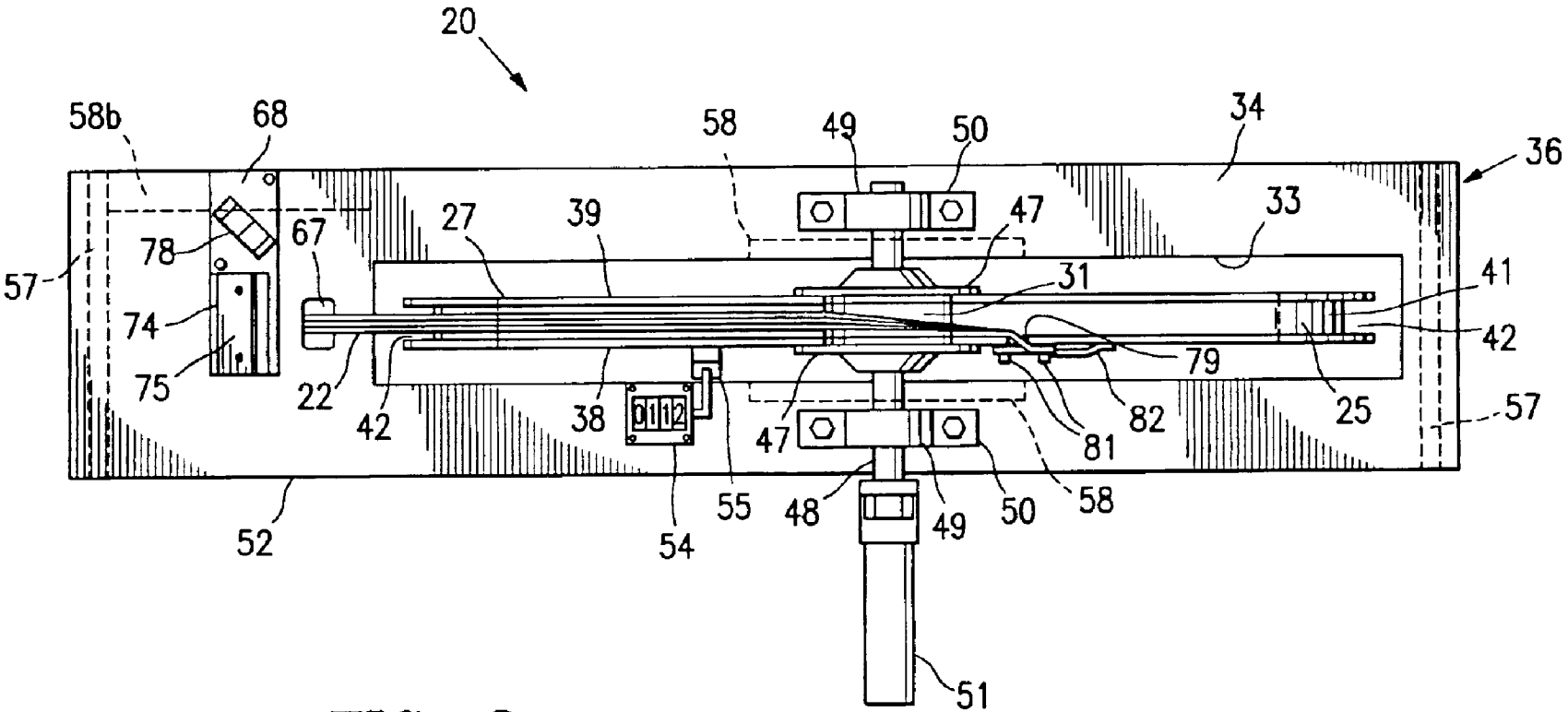
FIG. 2 is a plan view of FIG. 1.
Figure 7:
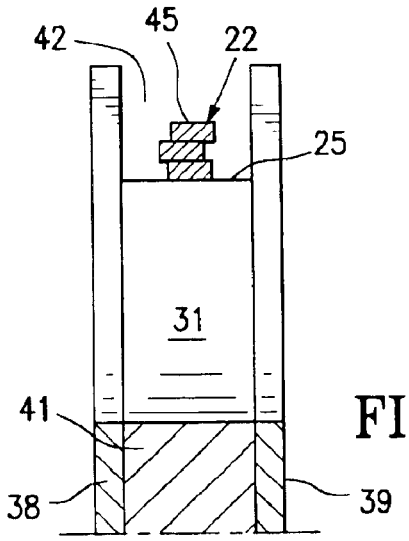
FIG. 7 is an enlarged view taken on line 7—7 of FIG. 1.

Rotatable wheel 27, FIGS. 1, 2, is disposed in a slot 33, elongated to a length longer than the diameter of wheel 27 , in a top panel 34 of a frame 36 for apparatus 20. Wheel 27 is composed of two (2) flat circular discs 38, 39, FIGS. 1, 2, of wood in between which a concentric circular member 41, FIG. 2, is disposed, formed by a suitable material, for example, of Styrofoam™. Member 41 includes a diameter of at least one (1") inch less than the diameter of wheel 27, so that an annular groove 42 is formed by the interior walls of the two (2) disc 38, 39 of wood and at the bottom of which peripheral surface 25 is formed to provide the circumferential measurement for ribbon strands 29. The thickness of member 41 is sufficient to accommodate the width 45, FIG. 7, of lengths of ribbon to be severed, these lengths usually one atop of the other in multiple revolutions of wheel 27. It should be understood from FIG. 7 that even though only three (3) ribbon lengths 22 are illustrated, one on top of another, that a suitable total number of revolutions of ribbon lengths 22 about wheel 27 is limited only by the depth of annular groove 42 and the thicknesses of the ribbon lengths 22 in the groove 42, and is not limited to the three (3) ribbon lengths 22 whose cross-sections are illustrated in FIG. 7.

Wheel 27 is supported in its position in slot 33, FIGS. 1, 2, by means of metal plates 47 suitably securely mounted to the outside walls of its wooden disc 38, 39 that have concentrically formed (not shown) holes in them, a shaft 48 extending through such holes and projecting out of aligned concentric holes (not shown) in plates 47 to journal bearings 49 whose flanges 50 are suitably securely mounted to top panel 34 to each side of slot 33. Thus wheel 27 is free to rotate above and below top panel 34 as a handle 51 suitably secured, outwardly of edge 52 of top panel 34, to the one end of shaft 48, FIG. 1, is manually rotated without any hindrance in the operation of the subject matter of the invention.

A conventional mechanical counter 54 is suitably secured to top panel 34 for cooperation with a tab or tripper 55 securely mounted to the one disc 38 of wood of wheel 27, so that each revolution of wheel 27 is counted as tripper 55 actuates counter 54 to record the number of revolutions as handle 51 rotates wheel 27. The total number of revolutions of wheel 27 determines the number of ribbon strands 29 that are produced in the operation of the invention.

Top panel 34 is suitably secured to end panels 57 in conventional manner, such as by nails, screws, or bolts (not shown), as well as by additional vertically-extending side panels 58 to support the weight of wheel 27, plates 47, and the journalled shaft 48 structures. A base 60 supports the entire apparatus 20, its top, end, and side frame panels being suitably secured or connected to it.

Figure 3:
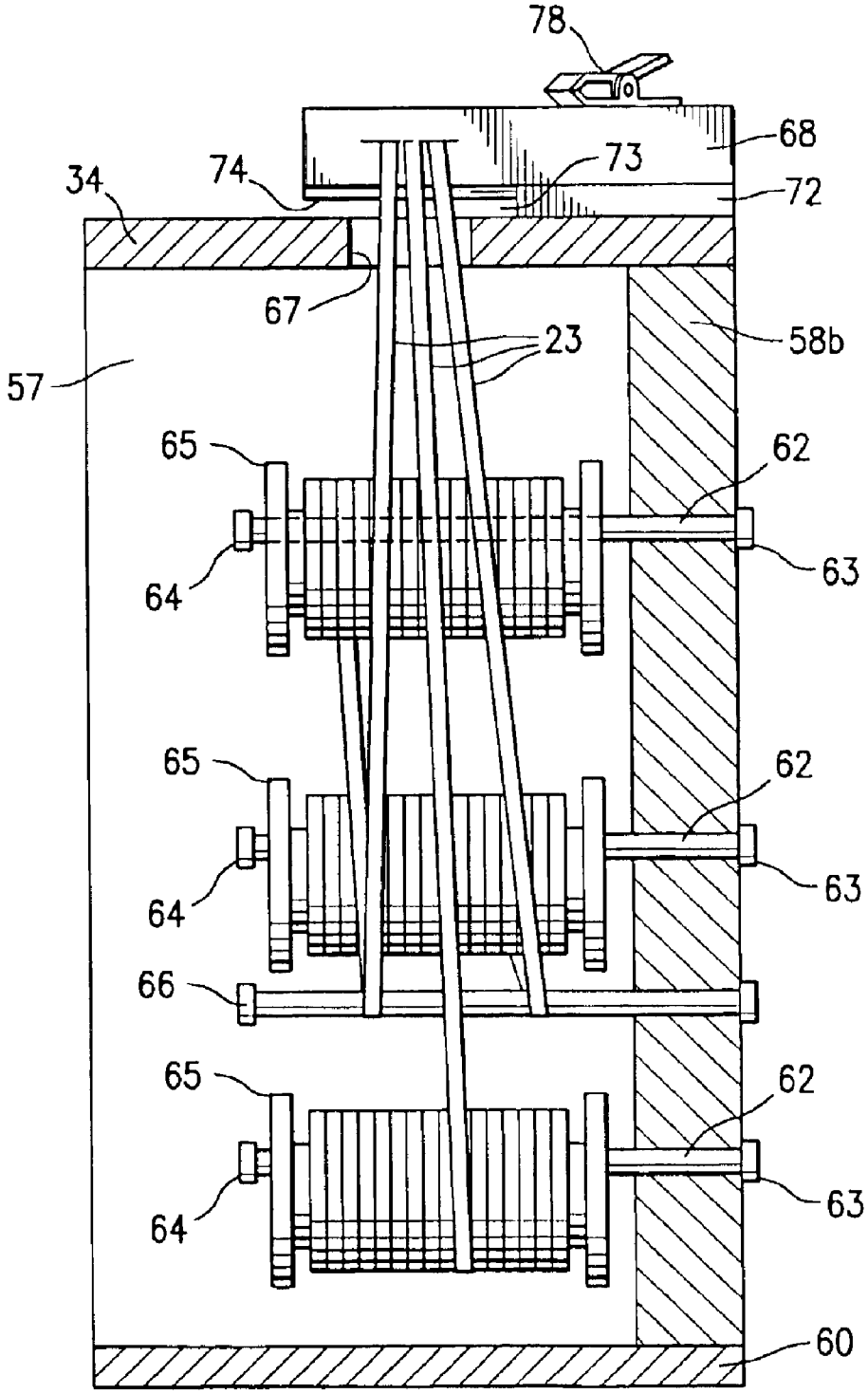
FIG. 3 is a view taken on line 3—3 of FIG. 1.

A compartment 61 is formed within frame 36 and in which one or more spool posts 62 are secured to a backing or panel 58*b* extending between top panel 34 and base 60. In the illustrated FIGURES of the embodiment, three (3) spool posts 62, FIG. 3, are utilized, each spaced from the other so that interference between them in their sizes and in the unwinding of spool ribbon materials 23 from them does not occur. Each spool post 62 is secured to backing panel 58*b* by a nut 63 or the like and includes a bolthead 64 at its other end over which a ribbon spool 65 can pass, be supported by its spool post 62 and be freely mounted for rotation thereabouts. Boltheads 64 on each post 62 prevents its ribbon spool 65 from sliding off its post 62 as its ribbon material 23 unravels or unwinds from its spool 65 in the operation of apparatus 20.

Figure 4:
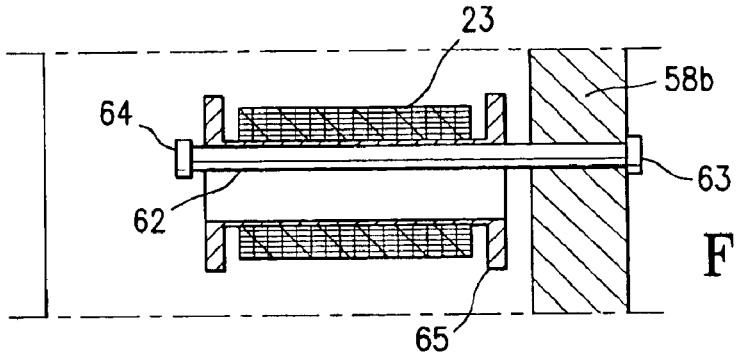
FIG. 4 is a view taken on line 4—4 of FIG. 1.

At least one post 66 is securely mounted in a likewise fashion as are spool posts 62 to backing panel 58*b* as an efficient guide by which an operator can gather together ribbon material 23 from the multiple numbers of spools 65 for guiding or threading them in a consolidated form to a slot 67 in top panel 34 which collects the consolidated or other form that ribbon material 23 may take. It should be understood that such a post 66 may be provided in frame 36 for each spool post 62 should it be desired. The small slot 67, formed in top panel 34, is of a size that provides free passage for width 45 of ribbon material 23, and is in general parallel alignment with the width of peripheral surface 25. The end or ends of one or a multiple number of ribbon material 23 and its/their subsequently following ribbon material are threaded to slot 67 in a consolidated or other convenient form desired by an operator, as the ribbon material 23, FIG. 4, is or are unwound from its one or corresponding number of spools 65 on posts 62.

Figure 5:
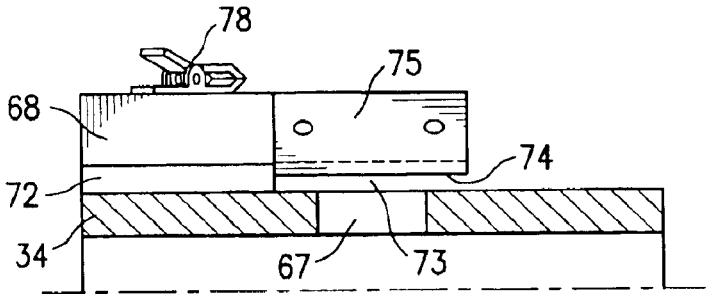
FIG. 5 is a view taken on line 5—5 of FIG. 1.
Figure 6:
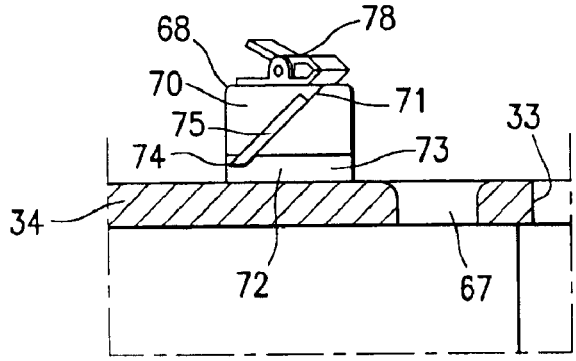
FIG. 6 is an enlarged fragmentary longitudinal side view, partly in section, of the curling and averting elements of FIGS. 5, 1A and 1B.

For curling a ribbon or ribbons, a curling mechanism or block 68, FIGS. 1, 1A, 3, 5, and 6, is securely mounted on top panel 34 at a position for ease of optional use during the operation of apparatus 20. Wooden block 68, FIGS. 3, 5, 6, is suitably securely mounted, such as by screws or glue (not shown), to top panel 34, with a portion 70 thereof cut out to form an inclined surface 71 , FIG. 6. A shim 72, FIG. 5, is used under the non-inclined-surface-portion of block 68 to form a space 73 under the inclined-surface portion 71 of block 68, so that ribbon material 23 can be introduced therethrough to a curling edge 74; such as, for example, an edge on an ordinary scissors, of a flat member 75 suitably securely mounted to inclined surface 71. The curling edge 74 of flat member 75 extends into space 73 for cooperation with ribbon material 23 to form a curled pattern in the length of the ribbon material 23. Curling edge 74 is in general parallel alignment with ribbon slot 67 so that in operation ribbon material 23 past or above slot 67 are easily slipped into space 73 and then pulled against curling edge 74 as lead ends 76, FIG. 1, of ribbon material 23 are pulled towards wheel 27 where they are to be held for operation of apparatus 20. A uniform length of curling throughout the entire length of ribbon material 23 applied to wheel 27 then is effected, as is illustrated in FIG. 8.

A conventional gripping clip 78, FIGS. 1, 1B, 5, 6, is provided at a convenient point on apparatus 20 , here atop the non-inclined surface portion of block 68. Its function is to avert the next set of lead ends of ribbon material 23 from gravitating back through ribbon slot 67 into compartment 61, which would require the operator to again advance or thread such next lead ends beginning at the spools 65 and their guidepost(s) 66. Its application during operation of apparatus 20 is immediately prior to cutting the ribbon lengths 22 at their wheel stations 31, the ribbon material 23 being handled by the operator at a point immediately above slot 67 and before the curling block 68, the ribbon material 23 taken from that point and introduced into clip 78, FIG. 1B. Then as the measured lengths of ribbon strands 29 are cut at severing stations 31, the uncut ribbon length(s) fall back from wheel 27, their lead ends not gravitating back through slot 67 by reason of clip 78 retaining such ribbon material 23.

Figure 1C:
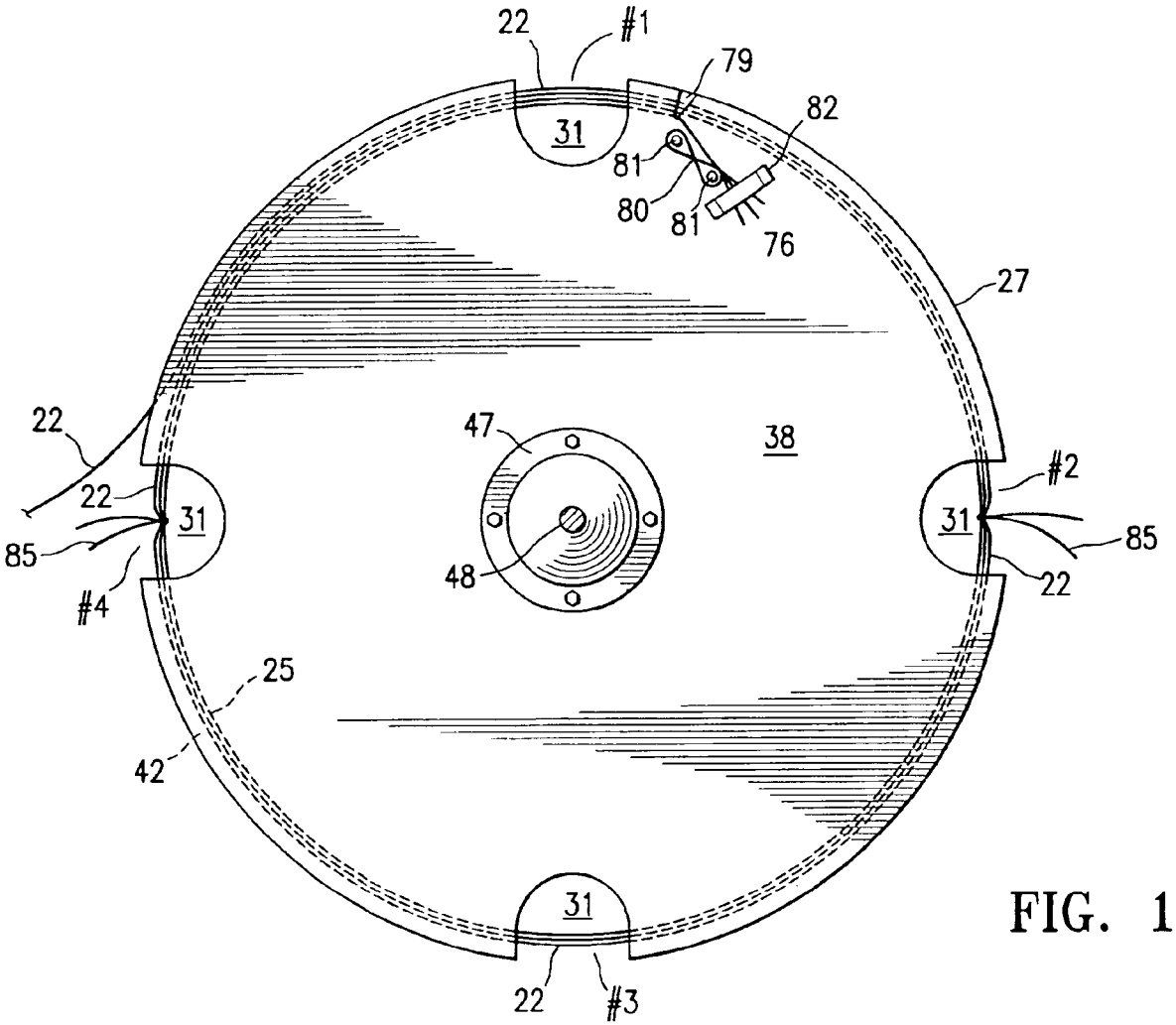
FIG. 1C is a fragmentary elevational view of the apparatus' wheel, showing the wheel with ribbon lengths held thereon in preparatory mode for producing one or more ribbon strands by cut of ribbon length(s).

As a preparatory step or as a step in operation of apparatus 20, FIG. 1C, the lead ends 76 of ribbon lengths 22, curled or uncurled, are fed into annular groove 42 to just past severing station # 1 at which point the ribbon lengths 22 are slid through a slit 79 formed in disc 38 to be held in a looped configuration 80 about small anchors 81 on disc 38, after which a piece of tape 82 may optionally be use to holds lead ends 76 to the side of disc 38. Previously, a threading action has been manually undertaken by an operator to gather together the spools' ribbon materials' lead ends 76 hanging from their corresponding spool(s) 65 on their posts 62, to guide them around guide post 66 into their consolidated form and onwardly to and through ribbon slot 67. Thereafter, but without utilizing the curling mechanism, lead ends 76 are introduced into annular groove 42 of wheel 27, being fed to just past station # 1 on wheel 27, and as described above held to the side wall of disc 38.

The operator turns wheel 27 (in direction of arrows, FIG. 1) by handle 51 an indefinite or definite number of revolutions and stops wheel 27. Ties 85 are applied to ribbon lengths 22, say, at severing stations # 2 and # 4, after which cut of ribbon lengths 22 by the operator are made at stations # 1 and # 3. Assuming an eight (8) foot peripheral surface 25 on wheel 27, two (2) sets of four (4) foot ribbon strands 29 are obtained, one (1) set of ribbon strands 29 being held together by one of the two (2) ties 85 and the other one (1) set of ribbon strands 29 being held together by the other one of the two (2) ties 85, while the short uncut ribbon lengths 22 still integral to their ribbon material 23 on their spools 65 drop from wheel 27 but do not gravitate back through slot 67 as a result of clip 78 gripping the ribbon material 22 that leads to the next set of lead ends on such ribbon material 22. The number of strands for each or both sets are determined by the number of revolutions undertaken in a cycle of operation.

The same cycle of operation may obtain one (1) set of eight (8) foot ribbon strands 29, by tying the wheel-mounted ribbon lengths 22 at severing station # 3, FIG. 1C, and cutting the lengths 22 at station # 1, the total being one set of eight (8) foot strands. The number of strands 29 depend upon the number of revolutions on wheel 27 of ribbon lengths 22 undertaken.

Assembly of apparatus 20 appears to be evident from the drawing FIGURES and the above description, however, not necessarily assembled in the following order, slit 79 is conventionally formed in the one wooden disc 38 at its circumference adjacent to the # 1 cut-out recess prior to assembly of fabricated discs 38, 39 to one another and to member 41. Concentric introduction of journalled shaft 48, while journalled bearings 49 and flanges 50 are mounted to top panel 34 to each side of slot 33. Handle 51 is attached to shaft 48 before or after mounting this subassembly into slot 33. Frame 36 composed of top panel 34, base 60, wooden panels 57, 58, are assembled together in conventional manner by glue, screws or other suitable fasteners. Posts 62, 66 are attached to the compartment backing 58*b*. The curling and averting mechanism elements, 74/75 and 78, respectively, are fabricated prior to securely mounting the two on block 68 adjacent to the one end of top panel 34.

Various changes and modifications may be made in the subject matter of this invention without varying or departing from the scope or spirit of the invention. Peripheral surface 25 is not limited in its circumference to eight (8) feet, as larger or smaller surfaces and their wheels fall within such spirit and scope.

Industrial Applicability

This invention is applicable to ribbon strands, curled and/or uncurled, of variously desired materials, sizes, weights, and lengths the nature of which may suitably vary.

I claim:

1. An apparatus for cutting ribbon lengths of one or more ribbon material into one or more measured ribbon strands, said apparatus comprising a frame having top panel means provided with a first slot, a base, support means joining said top panel means to said base, and a compartment formed within said frame between said top panel means and base for disposition of at least one ribbon material spool means, wheel means rotatably mounted in said first slot and having peripheral surface means thereon, said wheel means freely rotatable about and within said frame, means within said compartment securely mounted to said frame for supporting at least one ribbon material spool means, means for rotating said wheel to wind ribbon lengths from the ribbon material spool means onto said peripheral surface means, station means circumferentially mounted on said wheel means for severing ribbon lengths wound about said peripheral surface means thereby forming ribbon strands, and means included in said frame for collecting ribbon material unraveling from the ribbon material spool means mounted on said supporting means to wind thereafter onto said wheel means, whereby upon actuation of said wheel means and unraveling of ribbon material on the ribbon material spool means, the ribbon material advances to and through said collecting means and thereafter to wind onto said wheel means as ribbon lengths, stands of ribbon being generated by cutting at said severing station means the ribbon lengths wound on said peripheral surface means.

2. The apparatus of claim 1 including means securely mounted in said compartment for guiding ribbon material from the ribbon material spool means mounted on said supporting means to said collecting means in said top panel means.

3. The apparatus of claim 2 wherein said guiding means comprises a post in general parallel alignment with said supporting means.

4. The apparatus of claim 2 wherein said guiding means is disposed in said compartment substantially directly below said collecting means.

5. The apparatus of claim 4 wherein said guiding means comprises a post in general alignment with said supporting means.

6. The apparatus of claim 1 including means for curling at least one ribbon length prior to its winding onto said wheel means.

7. The apparatus of claim 6 wherein said curling means comprises a curling edge securely mounted to said top panel means, a space being provided between said curling edge and said top panel means into which a ribbon length for curling is insertable prior to the ribbon length being wound onto said wheel means.

8. The apparatus of claim 1 including means mounted on said top panel means for averting gravitation back through said collecting means of one or more ribbon lengths after a cut thereof has produced one or more ribbon strands.

9. The apparatus of claim 8 wherein said averting means is a clip for gripping at least one ribbon length.

10. The apparatus of claim 1 including means on said supporting means for maintaining a spool of ribbon thereon from slipping off of it during operation of said apparatus.

11. The apparatus of claim 10 wherein said supporting means is a rod means, said maintaining means comprising a head on said rod means for maintaining ribbon material spools on said supporting means, and means for counting the number of revolutions of said wheel means and by which a count of ribbon strands of measured lengths is effected, said counting means comprising a counter securely mounted on said frame for cooperating with a count tripper securely mounted to said wheel.

12. The apparatus of claim 11 including means for curling said ribbon lengths securely mounted on said top panel.

13. The apparatus of claim 1 including means for counting the number of revolutions of said wheel means and by which a count of ribbon strands of measured lengths is effected.

14. The apparatus of claim 13 wherein said counting means comprises a counter securely mounted on said frame for cooperating with a count tripper securely mounted to said wheel.

15. The apparatus of claim 1 including means securely mounted in said compartment for guiding ribbon material from said ribbon material spool means mounted on said supporting means to said collecting means in said frame, means for curling at least one ribbon length prior to its winding onto said wheel means, means mounted on said top panel means for averting gravitation back through said collecting means of one or more ribbon lengths after a severance thereof has produced one or more ribbon strands, and means on said supporting means for maintaining a spool of ribbon thereon from slipping off of it during operation of said apparatus, and means for counting the number of revolutions of said wheel means and by which a count of ribbon strands of measured lengths is effected.

16. The apparatus of claim 1 including means for curling at least one ribbon length prior to its winding onto said wheel means, and means mounted on said top panel means for averting gravitation back through said collecting means of one or more ribbon lengths after a cut thereof has produced one or more ribbon strands.

17. The apparatus of claim 16 including means securely mounted in said compartment for guiding ribbon material from said ribbon material spool means mounted on said supporting means to said collecting means.

18. The apparatus of claim 1 including means on said supporting means for maintaining a spool of ribbon material thereon from slipping off of it during operation of said apparatus, and means for counting the number of revolutions of said wheel means and by which a count of ribbon strands of measured lengths is effected.

19. The apparatus of claim 18 including means securely mounted in said compartment for guiding ribbon material from said ribbon material spool means mounted on said supporting means to said collecting means.

20. The apparatus of claim 1 including means for curling at least one ribbon length prior to its winding onto said wheel means, means for counting the number of revolutions of said wheel means and by which a count of ribbon strands of measured lengths is effected.

21. The apparatus of claim 20 including means securely mounted in said compartment for guiding ribbon material from said ribbon material spool means mounted on said supporting means to said collecting means.

22. The apparatus of claim 1 including means mounted on said top panel means for averting gravitation back through said collecting means of one or more ribbon lengths after a cut thereof has produced one or more ribbon strands, and means for counting the number of revolutions of said wheel means and by which a count of ribbon strands of measured lengths is effected.

23. The apparatus of claim 1 wherein said collecting means is mounted on said top panel means of said frame.

24. The apparatus of claim 23 wherein said collecting means is a second slot in said apparatus.

25. The apparatus of claim 1 wherein said collecting means is a second slot in said frame.

26. The apparatus of claim 25 wherein said collecting means is a second slot in said top panel means of said frame.

* * * * *